US006488468B1

(12) United States Patent
Danielsson et al.

(10) Patent No.: US 6,488,468 B1
(45) Date of Patent: Dec. 3, 2002

(54) PULP PUMP

(75) Inventors: Peter Danielsson, Fagervik (SE); Kjell Forslund, Sundsbruk (SE)

(73) Assignee: Valmet Fibertech AB (SE)

( * ) Notice: Subject to any disclaimer, the term of this patent is extended or adjusted under 35 U.S.C. 154(b) by 0 days.

(21) Appl. No.: 09/807,309

(22) PCT Filed: Oct. 4, 1999

(86) PCT No.: PCT/SE99/01755

§ 371 (c)(1),
(2), (4) Date: Apr. 11, 2001

(87) PCT Pub. No.: WO00/22303

PCT Pub. Date: Apr. 20, 2000

(30) Foreign Application Priority Data

Oct. 13, 1998 (SE) ..... 9803495

(51) Int. Cl.[7] ..... F04D 7/04
(52) U.S. Cl. ..... 415/126; 415/169.2
(58) Field of Search ..... 416/231 B; 415/169.1, 415/169.2, 126, 199.4, 199.5, 220, 221, 230

(56) References Cited

U.S. PATENT DOCUMENTS 4,776,758 A * 10/1988 Gullichsen ..... 415/169.1
5,114,310 A * 5/1992 Haavik et al. ..... 415/143
5,116,198 A * 5/1992 Vesala et al. ..... 415/143
5,151,010 A * 9/1992 Vesala et al. ..... 415/143
5,152,663 A * 10/1992 Peroaho et al. ..... 415/131
5,842,833 A * 12/1998 Reponen et al. ..... 415/143

FOREIGN PATENT DOCUMENTS

EP 0 474 478 A2 3/1992
EP 0 481 598 A2 4/1992
EP 0 395 236 B1 12/1993

* cited by examiner

*Primary Examiner*—Edward K. Look
*Assistant Examiner*—Richard A. Edgar
(74) *Attorney, Agent, or Firm*—Lerner, David, Littenberg, Krumholz & Mentlik, LLP

(57) ABSTRACT

Centrifugal pumps are disclosed for pumping a pulp suspension including a housing, a rotary shaft mounted within the housing, an impeller including a hub and blades, a wheel disk mounting the blades and including openings for discharging gas generated in the pump, vacuum blades mounted on the hub behind the wheel disk, a vacuum housing enclosing the vacuum blades, the vacuum housing including an outer cylindrical wall which is radially displaced and eccentrically disposed with respect to the vacuum blades, the vacuum housing including a front wall and a rear wall separated from the vacuum blades by a gap, the rear wall being axially adjustable so that the gap between the vacuum blades and the rear wall can be adjusted to adjust the vacuum generated thereby, and a passageway for communication between the openings in the wheel disk and the suction opening.

5 Claims, 2 Drawing Sheets

PULP PUMP

FIELD OF THE INVENTION

The present invention relates to a centrifugal pump for pulp suspensions of lignocellulosic material. More particularly, the present invention relates to a pump where a gas, such as air, is separated from the pulp in the pump.

Gas which follows along with the pulp can cause significant problems during pumping with centrifugal pumps. The gas in the pulp collects in the form of bubbles, which accumulate in front of the impeller whereby the capacity of the pump deteriorates. This problem can be overcome by evacuating the gas from the space in front of the impeller, such as by means of vacuum pumps of the type comprising liquid ring pumps. These pumps often comprise a separate vacuum pump, whose suction line is connected to the sealing space of the pulp pump. These pumps can also be designed as a separate vacuum impeller in the form of a liquid ring impeller located on the shaft of the pulp pump so that a common drive for both impellers is obtained.

In the cases when a separate vacuum pump is used, the pulp pump becomes relatively complicated and expensive, due to the fact that several components are required in the system. When, a separate liquid ring impeller of a conventional type is placed on the same shaft as the pulp pump, the capacity of the liquid ring impeller is restricted for reasons of space.

SUMMARY OF THE INVENTION

In accordance with the present invention, these prior art pumps have been improved upon by the discovery of a centrifugal pump for pumping a pulp suspension comprising a housing including a housing inlet for the pulp suspension and a housing outlet for the pumped pulp suspension, a rotatary shaft within the housing, an impeller including a hub and a plurality of blades radially extending from the hub, the impeller mounted for rotation on the rotary shaft, a wheel disk mounting the plurality of blades, the wheel disk including a front face facing the hub and a rear face, the wheel disk including openings for discharging gas generated in the pump, a plurality of vacuum blades mounted for rotation on the hub behind the rear face of the wheel disk, a vacuum housing enclosing the plurality of vacuum blades, the vacuum housing including an outer cylindrical wall radially displaced from the plurality of vacuum blades, the outer cylindrical wall being eccentrically disposed with respect to the plurality of vacuum blades, the vacuum housing further including a front wall proximate to the rear face of the wheel disk, and a rear wall distal from the rear face of the wheel disk and separated from the plurality of vacuum blades by a gap, the front wall including a suction opening for receiving the gas, the rear wall including an exhaust opening for exhausting the gas, the rear wall being axially adjustable whereby the gap between the plurality of vacuum blades and the rear wall can be adjusted in order to adjust the vacuum generated thereby, and a passageway disposed between the rear face of the wheel disk and the front wall for communication between the openings in the wheel disk and the suction opening. Preferably, the front wall includes at least one aperture and the pump includes a dilution chamber disposed radially outwardly with respect to the outer cylindrical wall for supplying dilution liquid to the passageway through the at least one aperture. In a preferred embodiment, the pump includes a shaft seal for the rotary shaft, the shaft seal defining a space axially adjacent to the rear wall, and the dilution chamber includes an opening in communication with the space, whereby the dilution liquid can externally flush the shaft seal.

In accordance with one embodiment of the centrifugal pump of the present invention, the pump includes a connector disposed adjacent to the vacuum chamber, whereby a separate vacuum system can be coupled to the centrifugal pump.

In accordance with the present invention, the aforesaid problems can be eliminated by the vacuum impeller being integrated in the impeller of the pulp pump. The structure of the present invention is compact and simple, and the capacity of the vacuum pump can be easily controlled. The pump is thus formed so that it can easily be combined with a separate vacuum pump, so that both pumps can be used in parallel. Alternatively, the separate vacuum pump can be coupled in at operation drop-out of the integrated vacuum pump according to the present invention in order to ensure accessability for the centrifugal pump.

BRIEF DESCRIPTION OF THE DRAWINGS

The present invention is described in greater detail in the following detailed description which, in turn, refers to the accompanying Figures illustrating an embodiment of the present invention, as follows.

DETAILED DESCRIPTION

Figure 1:
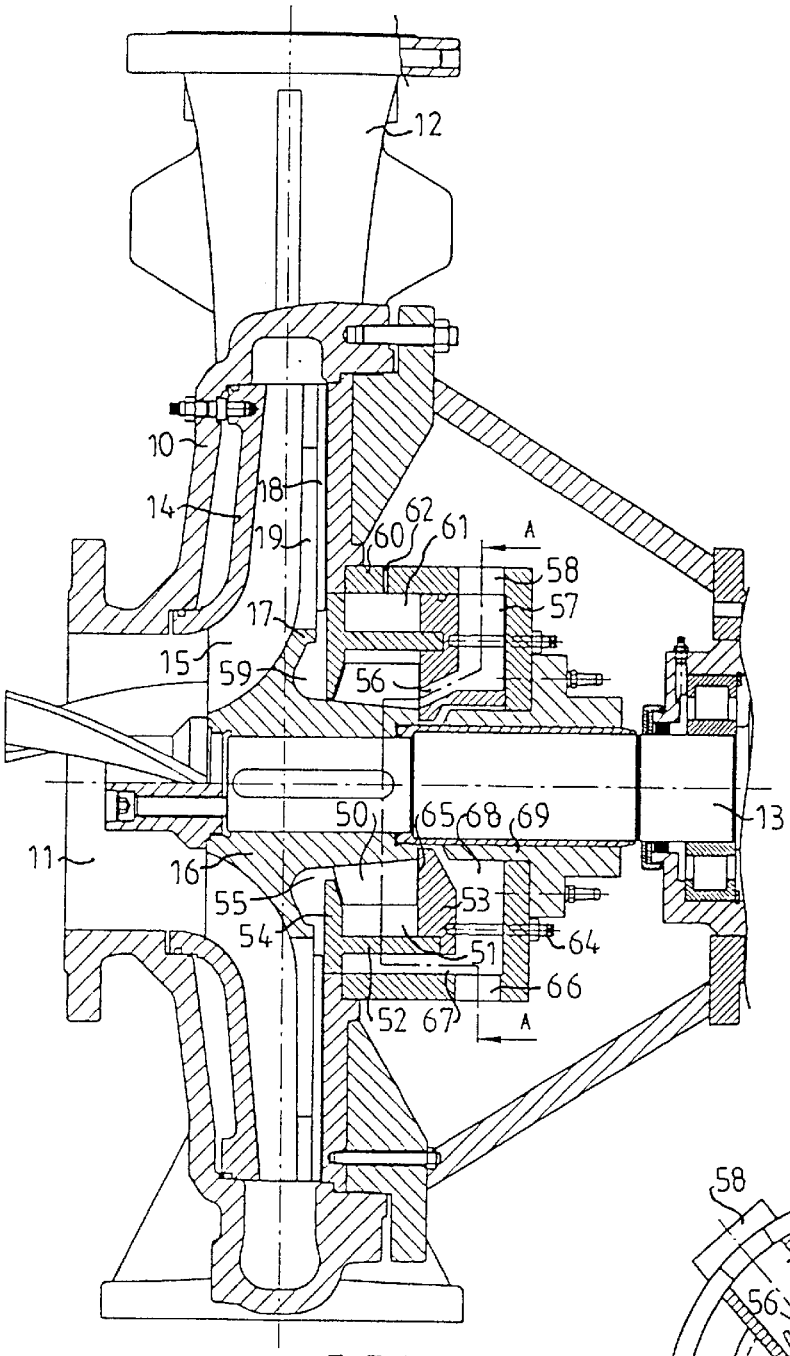
FIG. 1 is a side, elevational, sectional view of a centrifugal pump according to the present invention.
Figure 2:
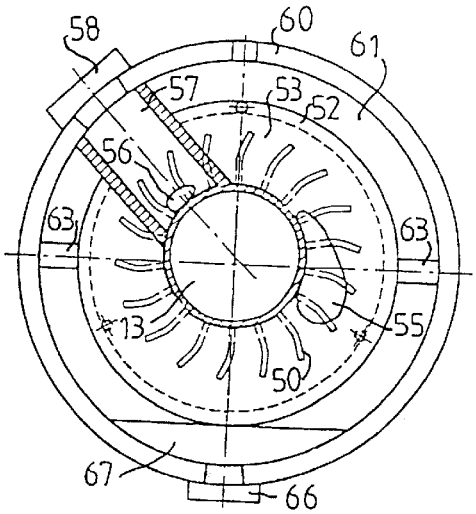
FIG. 2 is a front, elevational view taken along section A—A in FIG. 1.
Figure 3:
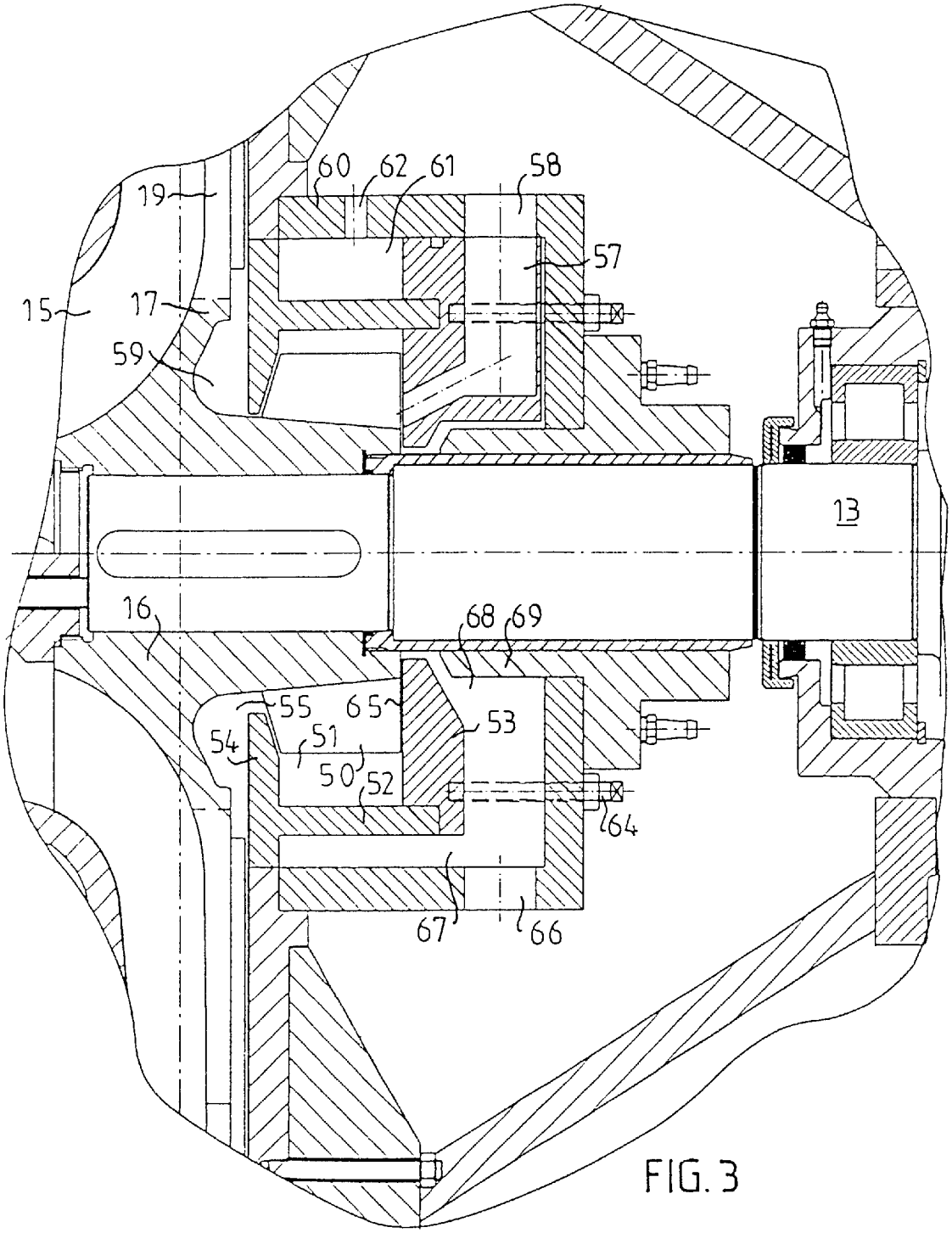
FIG. 3 is a side, elevational, partial, sectional, enlarged view of FIG. 1.

The centrifugal pump shown in the drawings comprises a pump housing 10 with an inlet 11 and an outlet 12 for the pulp suspension. Such pumps are used at relatively high pulp concentration, for example 8 to 12%. On a rotary shaft 13 in the pump housing 10 an impeller 14 with pump blades 15 is located, which extend from a hub 16 outwardly along a wheel disc 17. On the rear side of the wheel disc 17 rear blades 18 are located. The wheel disc 17 is formed with openings 19 for discharging gas which has collected in front of the impeller. The openings are preferably formed as slits extending outwardly from the hub 16.

Behind the wheel disc 17 the hub 16 is provided with vacuum pump blades 50, which are surrounded by a vacuum pump housing 51. Vacuum pump housing 51 comprises an outer cylindric wall 52, a rear wall 53 and a front wall 54. In order to render mounting and disassembling possible, the vacuum pump housing with its walls is divisible, preferably into two parts; namely, an upper and a lower half. The cylindrical wall 52 is eccentric in relation to the vacuum pump blades 50, so that a liquid ring pump is formed. In the front wall 54 there is a suction opening 55 for gas, and in the rear wall 53 there is an exhaust opening 56 for gas. These openings, 55 and 56, are spaced from each other in the circumferential direction, for gas suction into the vacuum pump housing, and gas exhaust from the vacuum pump housing, respectively. This effect is obtained by rotation of the vacuum pump blades and the volume variation in the circumferential direction of the vacuum pump housing as a consequence of the cylindrical wall 52 being disposed eccentrically.

The exhaust opening 56 communicates with a chamber 57 behind the rear wall 53 for gas evacuation through a gas outlet 58. On the rear side of the impeller 14, between the wheel disc 17 and the front wall 54 of the vacuum pump housing, a gas passage 59 is located for communication between the openings 19 in the wheel disc 17 and the suction opening 55.

In a sealing housing 60 in the pump housing 10, outside the outer wall 52 a dilution chamber 61 is located. This chamber 61 is provided with an inlet 62 for the supply of dilution liquid. Through openings 63 in the front wall 54, preferably located in the division surfaces in the divided vacuum pump housing 51, the chamber 61 communicates with the passage 59, whereby the supplied dilution liquid is utilized both as drive liquid to the liquid ring in the vacuum pump and as flushing liquid in the gas passage 59. The chamber 61 communicates also by means of a rear opening 67 in the rear wall 53 with a rear space 68 for a shaft sealing 69. The supplied flushing liquid can thus also be utilized for external flushing of the sealing 69 in the space 68.

The rear wall 53 of the vacuum pump housing 51 is axially adjustable in the sealing housing 60 by means of an adjusting device 64 for setting an axial gap 65 between the lateral edges of the vacuum pump blades 50 and the rear wall 53 for vacuum control.

An additional connection opening 66 in the sealing housing 60 to the dilution chamber 61 can preferably be provided to render it possible to couple-in a vacuum system or a vacuum pump coupled in parallel (not shown).

When a pulp suspension is pumped from the inlet 11 to the outlet 12, gas included in the pulp will collect in front of the impeller 14. The vacuum pump integrated in the hub 16 will then suck the gas through the openings 19 in the wheel disc 17 and, by means of the gas passage 59, into the vacuum pump, through the suction opening 55. By means of the pumping effect which is brought about by the vacuum pump blades 50 together with the rotating liquid ring in the vacuum pump housing 51 eccentric with the hub 16, the gas is pumped out through the exhaust opening 56 and evacuated through the gas outlet 58.

By adjusting the gap 65, the capacity of the vacuum pump can be controlled. By increasing the gap width, liquid leakage through the gap will increase, whereby the capacity of the vacuum pump is reduced, and vice versa.

When a separate vacuum pump is to be used, it is coupled to the connection 66 in order to de-air the gas passage 59 through openings 63 and dilution chamber 61. This separate vacuum pump can then operate in parallel with the integrated vacuum pump according to the present invention, or it can be coupled-in at operation drop-out of the integrated vacuum pump. In this manner, the drive of the centrifugal pump is ensured.

The invention, of course, is not restricted to the embodiments shown, but can be varied within the scope of the claims.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A centrifugal pump for pumping a pulp suspension comprising a housing including a housing inlet for said pulp suspension and a housing outlet for said pumped pulp suspension, a rotary shaft within said housing, an impeller including a hub and a plurality of blades radially extending from said hub, said impeller mounted for rotation on said rotary shaft, a wheel disk mounting said plurality of blades, said wheel disk including a front face facing said hub and a rear face, said wheel disk including openings for discharging gas generated in said pump, a plurality of vacuum blades mounted for rotation on said hub behind said rear face of said wheel disk, a vacuum housing enclosing said plurality of vacuum blades, said vacuum housing including an outer cylindrical wall radially displaced from said plurality of vacuum blades, said outer cylindrical wall being eccentrically disposed with respect to said plurality of vacuum blades, said vacuum housing further including a front wall proximate to said rear face of said wheel disk, and a rear wall distal from said rear face of said wheel disk and separated from said plurality of vacuum blades by a gap, said front wall including a suction opening for receiving said gas, said rear wall including an exhaust opening for exhausting said gas, said rear wall being independently axially adjustable whereby said gap between said plurality of vacuum blades and said rear wall is alterable in order to adjust the vacuum generated thereby, and a passageway disposed between said rear face of said wheel disk and said front wall for communication between said openings in said wheel disk and said suction opening.

2. The centrifugal pump of claim 1 wherein said front wall includes at least one aperture and including a dilution chamber disposed radially outwardly with respect to said outer cylindrical wall for supplying dilution liquid to said passageway through said at least one aperture.

3. The centrifugal pump of claim 2 including a shaft seal for said rotary shaft, said shaft seal defining a space axially adjacent to said rear wall, and said dilution chamber including an opening in communication with said space, whereby said dilution liquid can externally flush said shaft seal.

4. The centrifugal pump of claim 1 including a connector disposed adjacent to said vacuum housing, whereby a separate vacuum system can be coupled to said centrifugal pump.

5. A centrifugal pump for pumping a pulp suspension comprising a housing including a housing inlet for said pulp suspension and a housing outlet for said pumped pulp suspension, a rotary shaft within said housing, a shaft seal for said rotary shaft, an impeller including a hub and a plurality of blades radially extending from said hub, said impeller mounted for rotation on said rotary shaft, a wheel disk mounting said plurality of blades, said wheel disk including a front face facing said hub and a rear face, said wheel disk including openings for discharging gas generated in said pump, a plurality of vacuum blades mounted for rotation on said hub behind said rear face of said wheel disk, a vacuum housing enclosing said plurality of vacuum blades, said vacuum housing including an outer cylindrical wall radially displaced from said plurality of vacuum blades, said outer cylindrical wall being eccentrically disposed with respect to said plurality of vacuum blades, said vacuum housing further including a front wall proximate to said rear face of said wheel disk, and a rear wall distal from said rear face of said wheel disk and separated from said plurality of vacuum blades by a gap, said shaft seal defining a space axially adjacent to said rear wall, said front wall including a suction opening for receiving said gas and including at least one aperture, a dilution chamber disposed radially outwardly with respect to said outer cylindrical wall for supplying dilution liquid to said passageway through said at least one aperture, said dilution chamber including an opening in communication with said space, whereby said dilution liquid can externally flush said shaft seal, said rear wall including an exhaust opening for exhausting said gas, said rear wall being axially adjustable whereby said gap between said plurality of vacuum blades and said rear wall is alterable in order to adjust the vacuum generated thereby, and a passageway disposed between said rear face of said wheel disk and said front wall for communication between said openings in said wheel disk and said suction opening.

* * * * *